United States Patent [19]

Oreluk

[11] 4,070,645

[45] Jan. 24, 1978

[54] SELF CONTAINED UNIVERSAL FRONT END PROTECTOR

[76] Inventor: Jerome Allan Oreluk, 3156 S. Racine, Chicago, Ill. 60608

[21] Appl. No.: 742,749

[22] Filed: Nov. 18, 1976

[51] Int. Cl.[2] ..... H01H 3/16

[52] U.S. Cl. ..... 340/52 H; 340/61; 200/61.44

[58] Field of Search ..... 340/52 H, 61; 200/47, 200/61.41, 61.42, 61.43, 61.44

[56] References Cited

U.S. PATENT DOCUMENTS

| | | | |
|---|---|---|---|
| 2,177,386 | 10/1939 | Gearin | 340/61 |
| 2,221,330 | 11/1940 | Schneider | 340/61 |
| 2,253,041 | 8/1941 | Morse | 340/61 X |
| 3,037,187 | 5/1962 | Blakistone | 340/61 |

*Primary Examiner*—Alvin H. Waring

*Attorney, Agent, or Firm*—Merriam, Marshall & Bicknell

[57] ABSTRACT

Apparatus for automatically alerting the operator of vehicle to an impending collision between the operator's vehicle and a parked vehicle. The apparatus includes a wand and a mechanism for pivotably coupling the wand to a support arm extending from the vehicle. The coupling mechanism includes means for actuating a switch coupled to the vehicle's horn circuitry so that the horn sounds whenever the wand is contacted and moved by another vehicle or the like.

8 Claims, 5 Drawing Figures

SELF CONTAINED UNIVERSAL FRONT END PROTECTOR

BACKGROUND OF THE INVENTION

This invention relates generally to automotive accessories and more particularly to apparatus for alerting the operator of a motor vehicle of an impending low-speed collision between the operator's vehicle and another vehicle.

The technique used to parallel park an automobile or car into an open space between two other vehicles remains a mystery to many drivers. Those drivers simply do not have the experience necessary to successfully accomplish this maneuver. Further, certain automobile designs have resulted in restricted visibility through the rear window thereby increasing the difficulty of parallel parking. As a result, many inexperienced drivers and experienced drivers as well "feel" their way into the parking space. This involves slowly backing up until the rear bumper of the driver's automobile touches the parked vehicle immediately behind it. By alternately moving the automobile forward and backward and simultaneously repositioning the front wheels, the driver is eventually able to jockey the automobile between the two parked automobiles.

In most instances the automobile is moving very slowly and no significant damage results because the automobile being parked makes contact with the bumper of the parked automobile. This is not the case, however, where the parked automobile is a low slung sports car having bumpers substantially lower to the ground than more conventional vehicles. Because the bumper of the sports car is not aligned with the bumper of the larger vehicle, upon contact the larger vehicle often strikes the grillwork or hood of the sports car. Thus, over the years many sports car enthusiasts have returned to their parked vehicles only to discover that another driver in attempting to parallel park in front of their automobile has backed too far and damaged the grill or the hood area of their automobile. With the rising costs of repair and insurance and in view of the typical sports car owner's pride in his automobile, this is most undesirable.

Similarly, for the same reasons, it is desirable that a driver attempting to back or parallel park a vehicle avoids hitting a parked vehicle or any other object behind the vehicle. This is particularly true when the driver's vision is severely obstructed by his own vehicle. This problem is most acute when the vehicle is a semi-trailer truck, bus, recreational vehicle or the like.

SUMMARY OF THE INVENTION

Thus, in accordance with the present invention there is provided apparatus for alerting the driver or operator of a vehicle to an impending collision between the driver's vehicle and a parked vehicle. In one embodiment, the apparatus is installed on the parked vehicle to sound the horn of the parked vehicle whenever the driver's vehicle is within a predetermined distance of the parked vehicle. The apparatus generally comprises a wand and a support arm for mounting the wand to the parked vehicle at a predetermined distance therefrom in a generally vertical direction. Means are provided for pivotably coupling one end of the wand to the support arm. Responsive to the second vehicle contacting the wand, means coupled to the wand enables a switch means coupled to the horn circuitry of the parked vehicle, causing the horn to sound and alert the driver of the second vehicle. Alternatively, the apparatus can be utilized with the vehicle being parked to enable the driver to gauge his position relative to the parked vehicle or any other stationary object. When used in such a manner, other alarm means may be provided to alert the driver rather than using the vehicle's horn.

BRIEF DESCRIPTION OF THE DRAWINGS

The features of this invention which are believed to be novel are set forth with particularly in the appended claims. The invention together with its further objects and advantages thereof, may be best understood, however, by reference to the following description taken in conjunction with the accompanying drawings, in which like reference numerals identify like elements in the several figures and in which:

DETAILED DESCRIPTION

Figure 1:
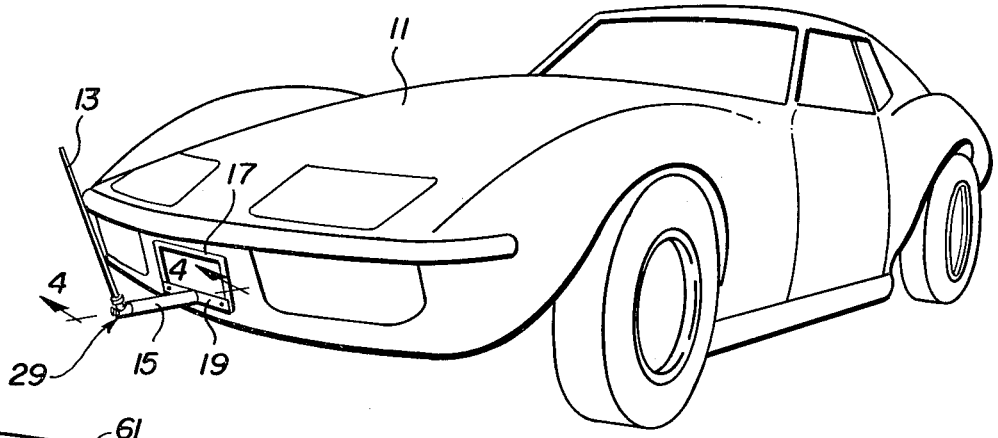
FIG. 1 is a perspective view showing the apparatus of the present invention installed on a motor vehicle such as a sports car.

In the particular embodiment illustrated in the drawings, the apparatus of the present invention is shown affixed to the front end of an automobile 11. More particularly, the apparatus shown there includes a long, slender rod or wand 13 having one end coupled to a tubular support arm 15 which, in turn, is fastened to and extends forwardly from the license plate holder or frame 17 of the automobile 11.

Figure 3:
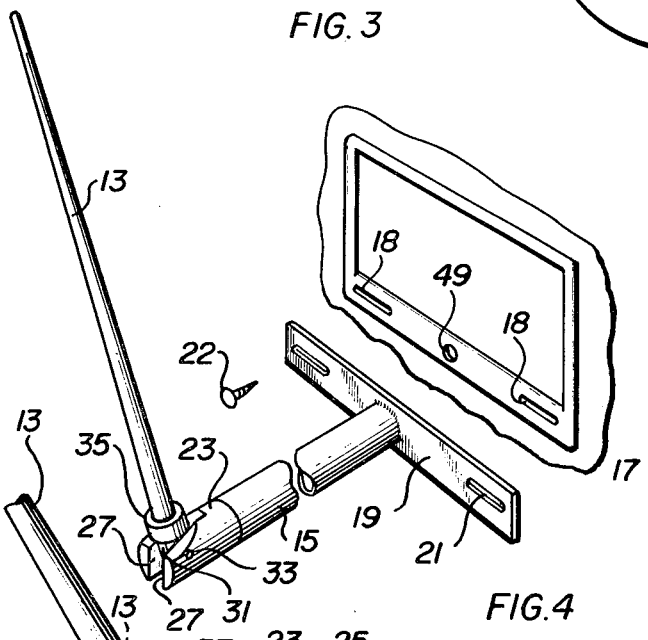
FIG. 3 is a partially exploded perspective view of the apparatus illustrating means for mounting the apparatus to the motor vehicle.

As shown in FIG. 3, an integral mounting plate 19 is provided at the other end of the suppot arm 15 for fastening the apparatus to the automobile 11. The mounting plate 19 is flat and rectangular and has slots 21 therein which allow the mounting plate 19 to be bolted to the license plate frame 17, together with the license plate which, for clarity, is not shown. The slots 21 extend laterally along the mounting plate 19 and are substantially coextensive with the slots provided in the license plate. These slots 21 permit the mounting plate 19 to be affixed to the license plate frame 17 of virtually any make and model of motor vehicle along with the license plate by means of bolts or screws 22 engaging slots 18 in the frame 17.

Figure 5:
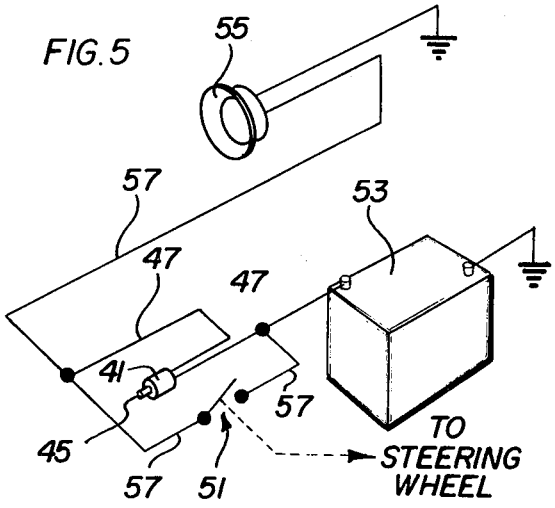
FIG. 5 illustrates the electrical connection of the apparatus into the horn circuitry of the vehicle.
Figure 4:
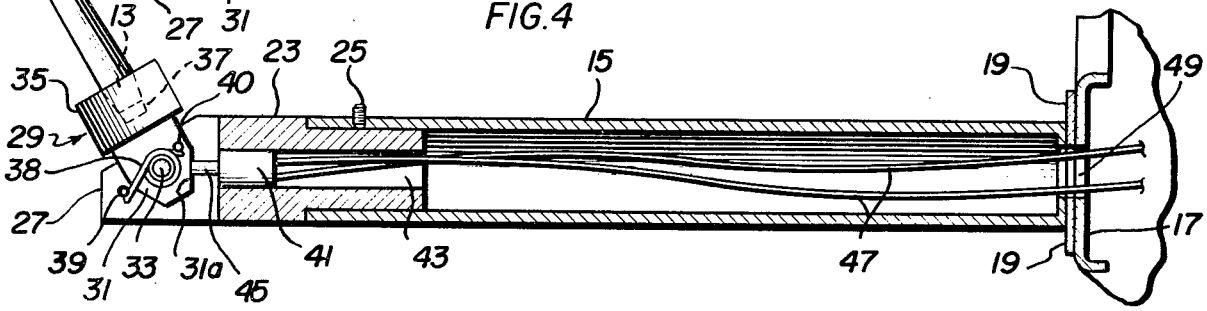
FIG. 4 is a sectional view of the apparatus taken along lines 4—4 in FIG. 1.

The wand 13, in turn, is pivotably coupled to the tubular support arm 15 by a coupling mechanism comprising, in part, a yoke 23 which is inserted into and extends from the other or outer end of the tubular support arm 15. The yoke 23, as shown in FIGS. 4 and 5, comprises a tubular piece of metallic or plastic material which has been machined or molded, as the case may be, to provide a cylindrical outer surface having an outer diameter substantially equal to the inner diameter of tubular support arm 15 over part of its length thereby permitting the yoke 23 to be inserted partially into the tubular support arm 15. A set screw 25 extends through a correspondingly threaded hole in the support arm 15 and may be tightened against the inserted portion of the yoke 23 to prevent the yoke 23 from twisting relative to the support arm 15 and hence the automobile 11. The outer end of the yoke 23 is slotted to provide the pair of parallel finger members 27 which comprise the outer U-shaped portion of the yoke 23.

The coupling mechanism further includes a pivoted member identified generally at 29 and comprising in part a tongue 31 which is positioned between the finger members 27 of the yoke. A pin 33 extends through the tongue 31 and into or through the finger members 27 to permit the tongue 31 to pivot about the pin 33 within limitations imposed by the physical dimensions of the tongue 31 relative to the yoke 23. The pivoted member 29 also includes a cylindrical block 35 integrally connected to the tongue 31 and having a receptacle 37 therein for accepting and removably holding the end of the wand 13. As many be seen in FIG. 4, the end of the wand 13 is tapered to correspond to the taper of the walls of the receptacle 37. Thus, when inserted into the receptacle 37, the wand 13 is not only securely held therein due to the resultant friction, but it is also easily removed when the apparatus is not in use, e.g., when the automobile is being driven.

The quiescent position of the pivoted member 29 is established and generally maintained by a spring 38 having one end biased against a tab 39 on the inner surface of one of the finger members 27 and its other end biased against a tab 40 on the tongue 31. The wand 13 is preferably held in generally vertical direction with its free end tilted away from the automobile 11, an acceptable range being from 0° to about 45° outward from true vertical. The optimum angle of the wand 13 from a true vertical position depends on the combined length of the support arm 15 and the yoke 23 and the desired distance from the automobile 11 at which the alarm is sounded.

With reference now particularly to FIG. 4, it can be seen that a switch 41 is positioned in the tubular opening 43 through the yoke 23 so that the push-button actuator 45 of the switch extends outwardly between the finger members 27. Because the apparatus is exposed continuously to varying and often extreme weather conditions, the switch 41 should be water proof, dustproof and able to withstand severe physical shocks. In the present embodiment, a normally-closed type of switch is utilized, although with obvious modifications a normally-open switch can be substituted. Thus, when the push-button 45 is depressed, the switch 41 is open, and conversely, whenever the push-button 45 is released, the switch 41 is closed to allow electrical current to flow therethrough. In operation, the spring 38 biases the tongue 31 against the push-button 45 to open the switch 41. More particularly, in the present embodiment, the circumferential edge of the tongue 21 is beveled along the portion 31*a* of the tongue contacting the switch push-button 45 so that the tongue 31 in its normal quiescent position does just sufficiently depress the push-button 45 to open the switch 41.

A pair of wires 47 extend through the support arm 15 and corresponding apertures 49 in the end of the arm 15, the mounting plate 19 and license plate frame 17 to connect the switch 41 to the horn circuitry of the automobile as illustrated in FIG. 5. In particular, the switch 41 is connected in parallel with the horn switch 51 on the steering wheel which, when depressed, closes to actuate the horn of the automobile. Typically, the horn switch 51 is connected in series between one terminal of the vehicle's battery 53 and the horn 55 by an electrical conductor 57. The other terminals of the horn 55 and the battery 53 are coupled to ground or to a different DC voltage reference level to complete the electrical circuit. Thus, when either switch, 41 or 51, is closed, the battery 53 supplies current to the horn 55 to enable the horn 55 to sound an audible warning signal. Alternatively, the switch 41 could be coupled to the siren of an alarm system which has been installed to prevent theft of the automobile.

Figure 2:
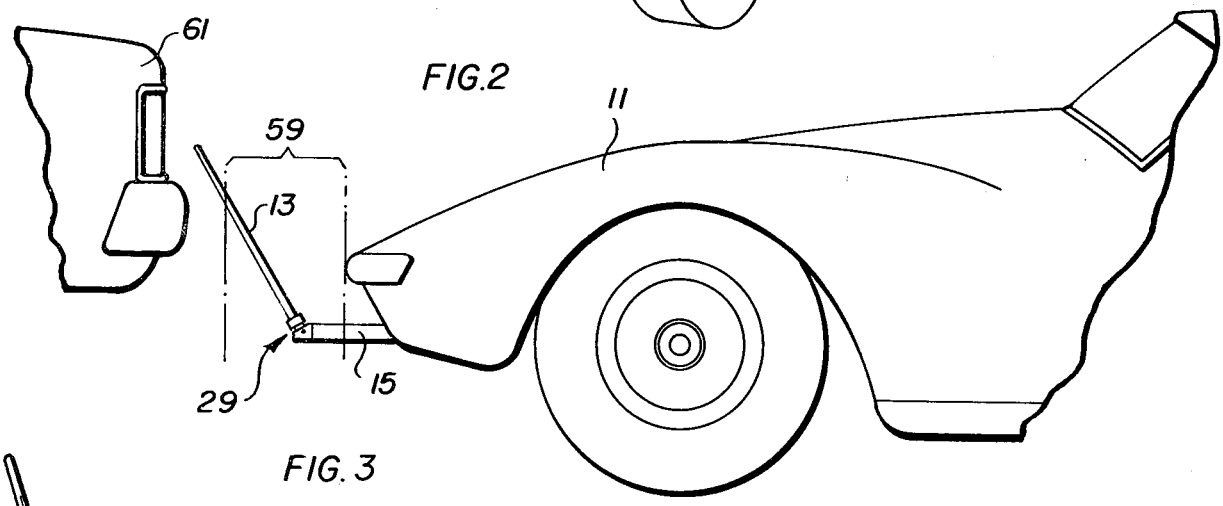
FIG. 2 is a side elevational view of the automobile shown in FIG. 1 further illustrating the apparatus of the present invention and its location when attached to the front end of the motor vehicle.

Operationally, if the wand 13 is pushed back toward the front end of the automobile 11, the beveled tongue portion 31*a* is forced away from the switch push-button 45 against the bias of the spring 38, releasing the push-button 45 and allowing the switch 41 to close and sound the horn 55. Accordingly, as illustrated in FIG. 2, the wand 13 defines a critical, protected area 59 in front of the automobile 11, which if encroached upon by another motor vehicle or object, causes the horn 55 of the automobile 11 to sound.

While the apparatus of the present invention is obviously useful when installed on parked vehicles to alert drivers of other vehicles of an impending collision with the parked vehicle, it will be understood that the apparatus of the present invention also is useful to aid drivers in backing or parking their vehicles. That is, by attaching the apparatus to the rear license plate holder of the vehicle so that the wand extends downwardly, the driver of the vehicle being backed or parked will be alerted whenever the vehicle is too close to another parked vehicle or other stationary object. In such applications, it may not be desirable to utilize the horn of the driver's vehicle to alert the driver to the fact that a collision is eminent, and accordingly, it may be preferably to provide a buzzer or other alarm means having a lower volume in the passenger compartment of the vehicle to alert the driver. Thus, instead of the circuit connection utilized in FIG. 5, the switch may simply be placed in series with a buzzer connected to a battery.

While a particular embodiment of the present invention has been shown and described, it will be obvious to those skilled in the art that various changes and modifications may be made without departing from the invention in its broader aspects. Accordingly, the aim in the appended claims is to cover all such changes and modifications as may fall within the true spirit and scope of the invention.

What is claimed is:

1. Apparatus for use with a moving vehicle or parked vehicle to automatically alert the operator of said moving vehicle to an impending collision between said moving vehicle and said parked vehicle, said apparatus comprising:

means selectively actuable to emit a perceptible alarm signal;

means including a switch coupled to said alarm means for selectively enabling said alarm means, said switch having push-button actuator means for opening and closing said switch;

a wand;

means mounted to one of said vehicles and extending outwardly therefrom to support said wand;

means for pivotably coupling said wand to said support means, said coupling means comprising a yoke coupled to said support means and means including a tongue member coupled to said wand, said yoke having a pair of horizontally displaced finger members extending outwardly from said support means and said tongue being positioned between said yoke finger members, said coupling means including a pin for pivotably coupling said tongue to said yoke finger members so that said wand extends in a generally vertical direction at a predetermined distance from said one vehicle, said switch being mounted in said yoke with said push-button actuator extending outwardly between said yoke finger members to selectively engage said tongue; and means for biasing said tongue to a quiescent position relative to said push-button actuator means where said switch is open-circuited, said switch being close-circuited to enable said alarm means whenever said wand is moved responsive to encroachment by said moving vehicle to within said predetermined distance of said parked vehicle.

2. Apparatus in accordance with claim 1 wherein said switch is normally closed when said push-button actuator means is not depressed and wherein said tongue is biased to contact and depress said push-button actuator means to open-circuit said switch whenever said tongue is at said quiescent position, said tongue releasing said push-button actuator means to close-circuit said switch responsive to said wand being moved.

3. Apparatus in accordance with claim 2 wherein said tongue has a circumferential edge having a beveled portion contacting said push-button actuator means just sufficiently to depress said push-button actuator means and open-circuit said switch when said tongue is biased to said quiescent position.

4. Apparatus in accordance with claim 1 wherein said biasing means comprises a spring having one end attached to said tongue and one end coupled to one of said yoke finger members.

5. Apparatus in accordance with claim 1 wherein said means coupled to said wand comprises a mounting block connected to said tongue and having a receptacle therein for accepting and holding one end of said wand, said wand being removable from said block whenever said apparatus is not in use.

6. Apparatus in accordance with claim 5, wherein the end of said wand is tapered and said receptacle is correspondingly tapered to frictionally engage said wand end and hold said wand while permitting said wand to be easily removed.

7. Apparatus in accordance with claim 1 wherein said apparatus is mounted to said parked vehicle and wherein said parked vehicle includes means comprising a horn and an operator-controlled horn switch means coupled to said horn for selectively actuating said horn to emit said alarm signal, said switch actuated by said wand being coupled to bypass said operator-controlled horn switch means and actuate said horn whenever said wand is moved.

8. Apparatus in accordance with claim 7 wherein said support means is tubular and including a pair of conductors extending through said tubular support means to couple said switch actuated by said wand in parallel with said operator-controlled horn switch means.

* * * * *